US011878205B2

(12) United States Patent
Campbell

(10) Patent No.: US 11,878,205 B2
(45) Date of Patent: Jan. 23, 2024

(54) UNIVERSAL PULLEY SYSTEM FOR POWER RACK

(71) Applicant: Jason Campbell, Nashville, TN (US)

(72) Inventor: Jason Campbell, Nashville, TN (US)

( * ) Notice: Subject to any disclaimer, the term of this patent is extended or adjusted under 35 U.S.C. 154(b) by 278 days.

(21) Appl. No.: 17/560,189

(22) Filed: Dec. 22, 2021

(65) Prior Publication Data

US 2022/0193483 A1 Jun. 23, 2022

Related U.S. Application Data

(60) Provisional application No. 63/129,324, filed on Dec. 22, 2020.

(51) Int. Cl.
*A63B 21/00* (2006.01)
*A63B 21/062* (2006.01)

(52) U.S. Cl.
CPC ..... *A63B 21/154* (2013.01); *A63B 21/0626* (2015.10)

(58) Field of Classification Search
CPC ... A63B 21/154; A63B 21/0626; A63B 17/02; A63B 21/156; A63B 21/062; A63B 23/03525; A63B 23/03558; A63B 21/4043; A63B 21/078; A63B 21/0628; A63B 2225/09
See application file for complete search history.

(56) References Cited

U.S. PATENT DOCUMENTS

| | | | | |
|---|---|---|---|---|
| 4,286,782 | A * | 9/1981 | Fuhrhop | A63B 23/00 482/99 |
| 4,603,855 | A * | 8/1986 | Sebelle | A63B 21/06 482/133 |
| 4,635,934 | A * | 1/1987 | Roethke | A63B 23/00 482/104 |
| 4,955,604 | A * | 9/1990 | Pogue | A63B 21/0783 482/99 |
| 6,217,493 | B1 * | 4/2001 | Spletzer | A63B 21/0605 482/103 |
| 8,172,733 | B1 * | 5/2012 | Batca | A63B 21/0628 482/99 |
| 11,260,261 | B2 * | 3/2022 | Henniger | A63B 21/4043 |
| 11,389,689 | B2 * | 7/2022 | Leipheimer | A63B 21/00069 |
| 2001/0034290 | A1 * | 10/2001 | Tolles | A63B 21/154 482/99 |
| 2004/0224827 | A1 * | 11/2004 | Ashley | A63B 21/02 482/130 |

(Continued)

*Primary Examiner* — Garrett K Atkinson
(74) *Attorney, Agent, or Firm* — Mark A. Pitchford; Eric B. Fugett; Pitchford Fugett, PLLC

(57) ABSTRACT

A pulley system for a weight rack includes an overhead pulley unit and a lower pulley unit. The overhead pulley is installed on an overhead crossmember of the weight rack to provide a plate loaded pull-down system. The overhead pulley has a main body and a mounting member recessed into it. A rear sheave is set off from the crossmember by the main body further than a front sheave. The front and rear sheaves support a cable for pull-downs. A lower pulley unit including a front lower body and a rear lower body is attached to a lower crossmember under the front sheave of the overhead pulley. The front lower body includes a sheave to redirect the cable laterally from the overhead pulley and a front face including a footrest and a notch to allow passage of the cable there through.

20 Claims, 7 Drawing Sheets

(56) References Cited

U.S. PATENT DOCUMENTS

| | | | | |
|---|---|---|---|---|
| 2007/0238583 | A1* | 10/2007 | Cunningham | A63B 23/03541 482/52 |
| 2019/0275363 | A1* | 9/2019 | Jones | A63B 21/0616 |
| 2020/0114195 | A1* | 4/2020 | Henniger | A63B 21/0442 |
| 2020/0222745 | A1* | 7/2020 | Leipheimer | A63B 23/03525 |
| 2021/0170218 | A1* | 6/2021 | Lewis-Dove | A63B 17/04 |
| 2022/0072361 | A1* | 3/2022 | Henniger | A63B 21/4029 |
| 2022/0134172 | A1* | 5/2022 | Henniger | A63B 21/0428 482/94 |
| 2022/0233909 | A1* | 7/2022 | Williams | A63B 21/0628 |
| 2023/0067866 | A1* | 3/2023 | Henniger | A63B 21/0428 |
| 2023/0173329 | A1* | 6/2023 | Nesemeier | A63B 21/062 482/103 |

* cited by examiner

UNIVERSAL PULLEY SYSTEM FOR POWER RACK

CROSS-REFERENCES TO RELATED APPLICATIONS

This application claims priority to and hereby incorporates by reference in its entirety U.S. Provisional Patent Application Ser. No. 63/129,324 entitled "UNIVERSAL PULLEY SYSTEM FOR POWER RACK" filed on Dec. 22, 2020.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to weight lifting power rack accessories. More particularly, this invention pertains to a pulley system for a power rack.

In recent years, weight lifting power rack systems have generally standardized tubing cross section sizes, hole sizes, and hole spacing. This allows different accessories to be used on racks produced by any manufacturer adhering to these standards. Additionally, by putting standard holes at standard spacing through the weight rack, accessories may be placed almost anywhere on the weight rack. Accessories include bar supports, limit straps, pulleys, dip bars, adjustable height pull-up bars, and other accessories. However, there can be significant deviations in these standards between racks and between manufacturers or even models based on tooling and production methods.

Power racks generally support barbells and allow a user to hang from them. A bar with plate weights can be lifted off hooks or straps on the weight rack and pushed overhead or squatted. The bar and plate weights may also be placed on the ground and pulled from the ground. Different pull-up grips may be used while hanging from the weight rack, but the motion of the user and the muscle stimulus does not vary much between grips. Pull downs and straight pulls or rows are popular movements to add variety of movement to back muscle exercises. Pulleys can be used on racks to produce these movements. Existing pulley systems are deficient in that they add too much height to a rack for the weight rack to fit in many spaces. That is, they add 7" or more of height to the weight rack which requires over 8' of clearance when installed on top of the weight rack crossbar. Additionally, existing pulley systems generally do not provide enough clearance from the input to output to space the user from weights lifted via the pulley, and if the crossmember to which the pulley is mounted is over another crossmember, the weights on the pulley contact the lower crossmember during use due to this lack of spacing between the weight side pulley and the crossmember.

BRIEF SUMMARY OF THE INVENTION

Aspects of the present invention provide a pulley system for a weight rack. An overhead pulley is installed on an overhead crossmember of the weight rack to provide a plate loaded pull-down system. The overhead pulley unit has a main body and a mounting member recessed into the main body. A rear sheave is set off from the crossmember by the main body further than a front sheave. The front and rear sheaves support a cable for pull-downs. A lower pulley unit including a front lower body and a rear lower body is attached to a lower crossmember under the overhead pulley. The front lower body includes a sheave to redirect the cable laterally from the overhead pulley and a front face including a footrest and a notch to allow passage of the cable there through. The rear lower body includes a rear tab under the rear sheave of the overhead pulley. The rear tab is configured to receive a workout band or carabineer for attaching to the cable and/or weights on the cable (i.e., to the plate holder 301) to provide progressive resistance to pull-downs or rows using the pulley system on the weight rack.

In one aspect, a pulley system for a weight rack includes a main body, a mounting member, a rear sheave pin, a front sheave pin, a rear sheave, and a front sheave. The main body is configured to extend longitudinally. The main body has a top, a bottom, a first side, and a second side opposite the first side. The mounting member is configured to extend laterally. The mounting member is at least partially recessed into the bottom of the main body. The mounting member includes a top, a front face connected to the top, a rear face connected to the top, and an open bottom between the front face and the rear face. The mounting member has a first hole through the front face of the mounting member. The mounting member has a second hole through the rear face of the mounting member. The first and second holes in the mounting member are laterally and vertically aligned such that the first and second holes cooperate to receive a rack pin there through when the system is mounted on the weight rack in an upright position to retain the system on the way rack. The rear sheave is at a rear end of the main body. The rear sheave extends vertically and longitudinally when the system is mounted on the weight rack in the upright position. The rear sheave pin extends laterally between the first side and the second side of the main body. The rear sheave pin mounts the rear sheave to the main body when the system is assembled. The front sheave is at a front end of the main body. The front sheave extends vertically and longitudinally when the system is mounted on the way rack in the upright position. The front sheave pin extends laterally between the first side and the second side of the main body. The front she pin mounts the front sheave to the main body when the system is assembled.

In another aspect, pulley system for weight rack includes a front lower body including a floorplate, a rear face, a lower body sheave, a sheave support, and a front face. The floorplate is configured to contact the floor upon which the weight rack is installed in front of the weight rack when the front lower body is installed on a lower crossmember of the weight rack in an upright position. The rear face extends upwardly from a rear edge of the floorplate when the front lower body is in an upright position. The rear face has at least 2 holes therethrough configured to align with holes in the lower crossmember of the weight rack. The holes are configured to receive rack pins there through to secure the front lower body to the lower crossmember of the way rack when the pins are inserted through the at least 2 holes and corresponding holes in the lower crossmember. The lower body sheave is configured to redirect the cable. The sheave support is configured to support the lower body sheave and stand lower body sheave off from the rear face of the front lower body. The sheave support extends forward from the rear face of the front lower body when the system is installed on the lower crossmember of the weight rack in the upright position. The front face of the front lower body extends generally upwardly from a front edge of the floorplate when the front lower body is installed on the way rack in the upright position. The front face has a notch therein extending upward from at least as low as a bottom of a groove in the lower body sheave. The front face forms an angle with respect to the floorplate of between approximately 75 and 85°.

In another aspect, a pulley system for a weight rack includes a main body, a mounting member, a rear sheave pin, a front sheave pin, a rear sheave, a front sheave, and a front lower body. The main body is configured to extend longitudinally. The main body has a top, a bottom, a first side, and a second side opposite the first side. The mounting member is configured to extend laterally. The mounting member is at least partially recessed into the bottom of the main body. The mounting member includes a top, a front face connected to the top, a rear face connected to the top, and an open bottom between the front face and the rear face. The mounting member has a first hole through the front face of the mounting member. The mounting member has a second hole through the rear face of the mounting member. The first and second holes in the mounting member are laterally and vertically aligned such that the first and second holes cooperate to receive a rack pin there through when the system is mounted on the weight rack in an upright position to retain the system on the way rack. The rear sheave is at a rear end of the main body. The rear sheave extends vertically and longitudinally when the system is mounted on the weight rack in the upright position. The rear sheave pin extends laterally between the first side and the second side of the main body. The rear sheave pin mounts the rear sheave to the main body when the system is assembled. The front sheave is at a front end of the main body. The front sheave extends vertically and longitudinally when the system is mounted on the way rack in the upright position. The front sheave pin extends laterally between the first side and the second side of the main body. The front she pin mounts the front sheave to the main body when the system is assembled. The front lower body includes a floorplate, a rear face, a lower body sheave, a sheave support, and a front face. The floorplate is configured to contact the floor upon which the weight rack is installed in front of the weight rack when the front lower body is installed on a lower crossmember of the weight rack in an upright position. The rear face extends upwardly from a rear edge of the floorplate when the front lower body is in an upright position. The rear face has at least 2 holes therethrough configured to align with holes in the lower crossmember of the weight rack. The holes are configured to receive rack pins there through to secure the front lower body to the lower crossmember of the way rack when the pins are inserted through the at least 2 holes and corresponding holes in the lower crossmember. The lower body sheave is configured to redirect the cable. The sheave support is configured to support the lower body sheave and stand lower body sheave off from the rear face of the front lower body. The sheave support extends forward from the rear face of the front lower body when the system is installed on the lower crossmember of the weight rack in the upright position. The front face of the front lower body extends generally upwardly from a front edge of the floorplate when the front lower body is installed on the way rack in the upright position. The front face has a notch therein extending upward from at least as low as a bottom of a groove in the lower body sheave. The front face forms an angle with respect to the floorplate of between approximately 75 and 85°.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
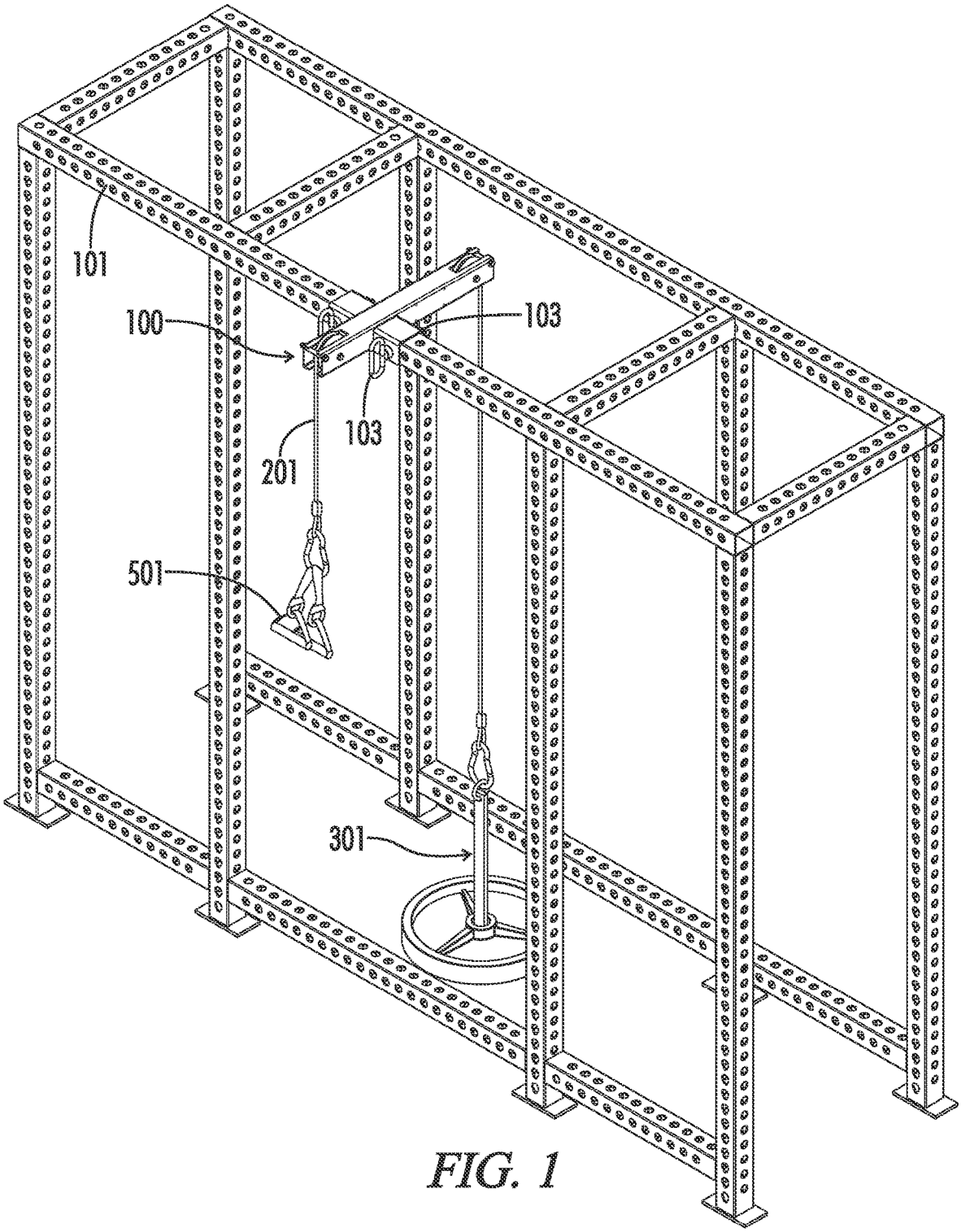
FIG. 1 is an isometric view of a pulley system installed on a weight rack in an upright position.
Figure 2:
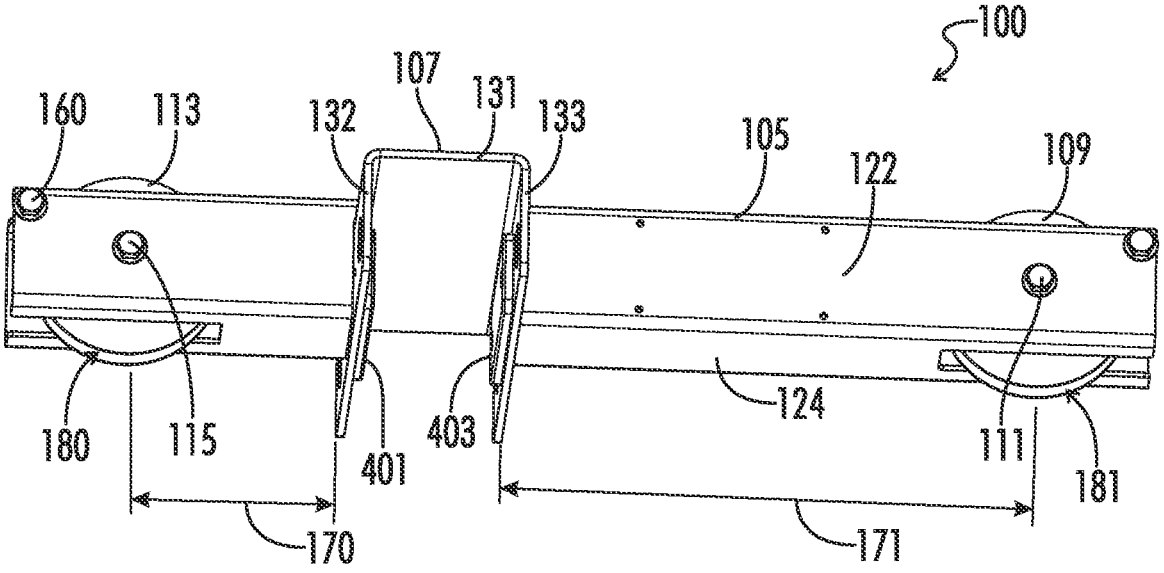
FIG. 2 is an isometric view of the pulley system of FIG. 1.
Figure 3:
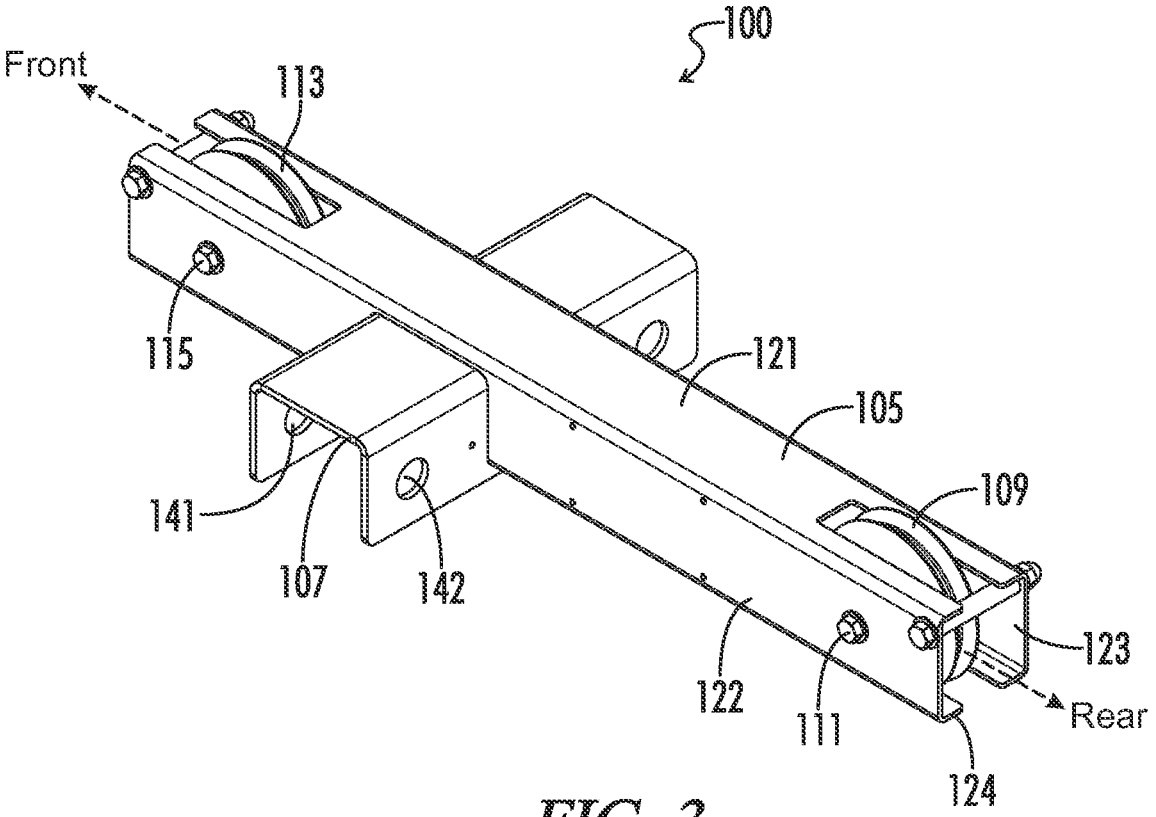
FIG. 3 is a rear isometric view of the pulley system of FIG. 1.
Figure 4:
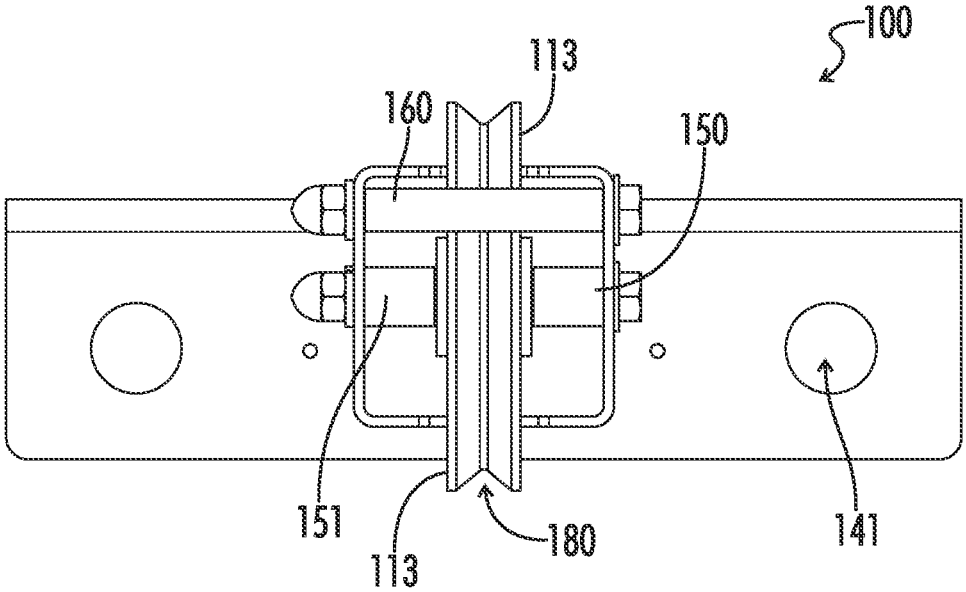
FIG. 4 is a front perspective view of the pulley system of FIG. 1.
Figure 5:
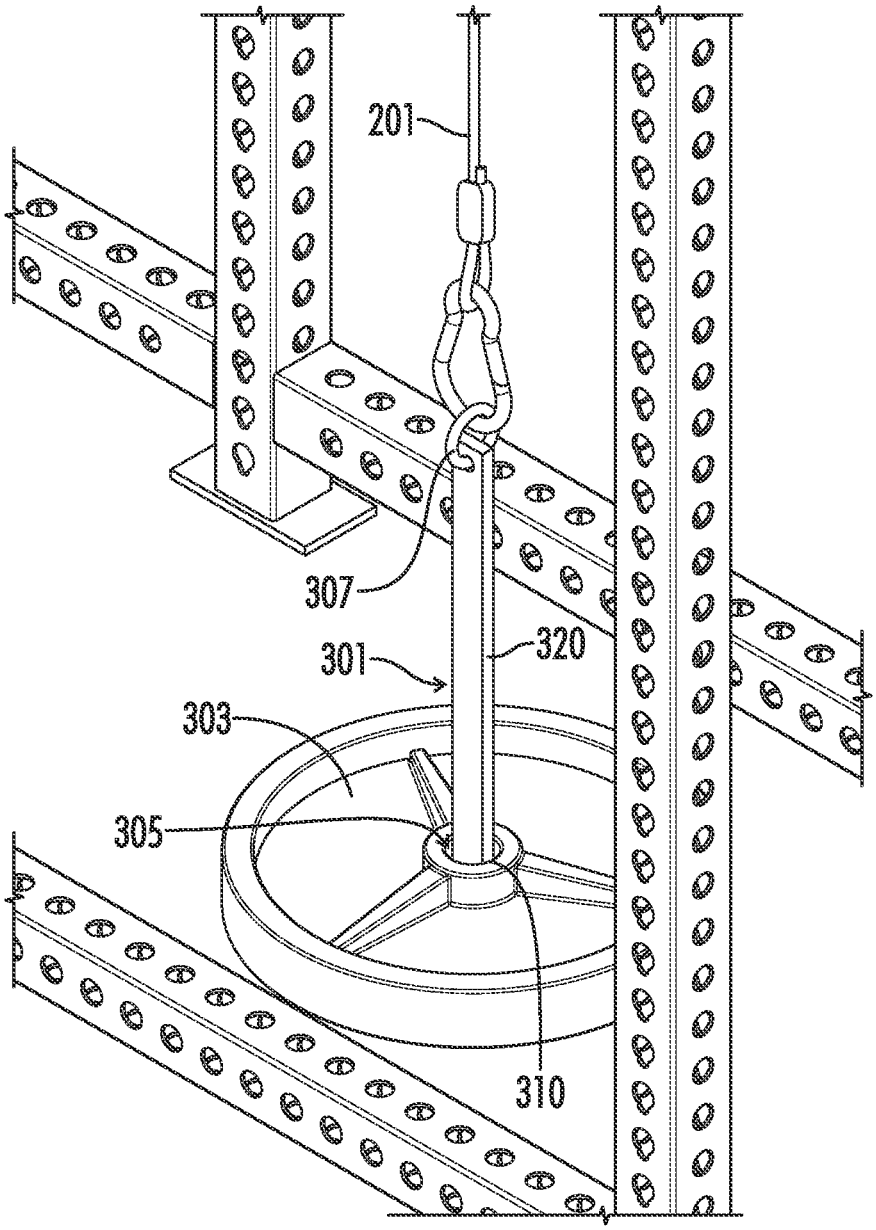
FIG. 5 is an isometric view of a weight plate holder of the system of FIG. 1.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position of the pulley system disclosed herein is when properly installed on a weight rack or power rack as shown, for example, in FIGS. 1, 5, and 6. The term "when" is used to specify orientation for relative positions of components, not as a temporal limitation of the claims or apparatus described and claimed herein unless otherwise specified. The terms "above", "below", "over", and "under"

mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Referring now to FIGS. 1-7, in one embodiment, a pulley system 100 or a weight rack 101 includes a main body 105, a mounting member 107, a rear sheave 109, a rear sheave pin 111, a front sheave 113, and a front sheave pin 115. The main body 105 is configured to extend longitudinally. The main body 105 includes a top 121, a bottom 124, a first side 122, and a second side 123 opposite the first side 122.

The mounting member 107 is configured to extend laterally (i.e., orthogonally to the longitudinal axis). Mounting member 107 is at least partially recessed into the bottom 124 of the main body 105. The mounting member 107 includes a top 131, a front face 132 connected to the top 131, and a rear face 133 connected to the top 131. The bottom of the mounting member 107 is open between the front face 132 and the rear face 133 such that the mounting member 107 forms a C channel configured to fit over the crossmember of the weight rack 101. In one embodiment, the mounting member 107 has a first hole 141 through the front face 131 of the mounting member 107, and a second hole 142 through the rear face 133 of the mounting member 107. The first and second holes 141, 142 are laterally and vertically aligned such that the first and second holes 141, 142 cooperate to receive the weight rack pin 103 there through when the system 100 is mounted on the weight rack 101 in an upright position to retain the system 100 on the weight rack 101. In one embodiment, the first hole 141 through the front face 132 of the mounting member 107 and the second hole 142 through the rear face 133 of the mounting member 107 are ovals which are longer in the lateral direction than the vertical direction when the system 100 is mounted on the weight rack 101 in the upright position.

The rear sheave 109 is at a rear end of the main body 105. The rear sheave 109 extends vertically and longitudinally when the system 100 is mounted on the weight rack 101 in the upright position. The rear sheave pin 111 extends laterally between the first side 122 and the second side 123 of the main body 105. The rear sheave pin 111 mounts the rear sheave 109 to the main body 105 when the system 100 is assembled. The front sheave 113 is at a front end of the main body 105. The front sheave 113 extends vertically and longitudinally when the system 100 is mounted on the weight rack 101 in the upright position. The front sheave pin 115 extends laterally between the first side 122 and the second side 123 of the main body 105. The front sheave pin 115 mounts the front sheave 113 to the main body 105 when the system 100 is assembled. In one embodiment, the rear sheave pin 111 extends through the rear sheave 109 to mount the rear sheave 109 between the first side 122 and the second side 123 of the main body 105 when the system 100 is assembled and in the upright position. In one embodiment, the front she pin 115 extends through the front sheave 113 to mount the front sheave 113 between the first side 122 and the second side 123 of the main body 105 when the system 100 is assembled and in the upright position. In one embodiment, the rear sheave pin 111 and the front sheave pin 115 are bolts retained in position by associated nuts. In one embodiment, the system 100 further includes a first pair of spacers 150 configured space the rear sheave 109 from the first side 122 of the main body 105 and the second side 123 of the main body 105. The first pair spacers 150 are supported by the rear sheave pin 111 when the system 100 is assembled and in the upright position. In one embodiment, the system 100 further includes a second pair spacers 151 configured to space the front sheave 113 from the first side 122 of the main body 105 and the second side 123 of the main body 105. The second pair of spacers 151 are supported by the front sheave pin 115 when the system 100 is assembled and in the upright position. In one embodiment, the front sheave pin 115 is positioned a first distance 170 from the front face 132 of the mounting member 107 when the system 100 is assembled, and the rear sheave pin 111 is positioned a second distance 171 from the rear face 133 of the mounting member 107 when the system 100 is assembled. The second distance 171 is greater than the first distance 170.

In one embodiment, the front sheave 113 has a groove 180 therein configured to receive a cable 201. Similarly, the rear sheave 109 has a groove 181 therein configured to receive the cable 201. The groove 180 in the front sheave 113 and the groove 181 in the rear sheave 109 extend above the top 121 of the main body 105 such that the cable 201 is supported above the top 121 of the main body 105 when the system 100 is installed on the weight rack 101 in the upright position with the cable 201. In one embodiment, the system 100 further includes the cable 201 which is configured to extend between the front sheave 113 and the rear sheave 109 and downward from the front sheave 113 and the rear sheave 109 when the system 100 is installed on the weight rack 101 in the upright position.

In one embodiment, the system further includes a cable retainer pin 160 extending laterally between the first side 122 and the second side 123 of the main body 105. The cable retainer pin 160 is forward of the front sheave pin 115 in space from the front sheave 113 when the system 100 is assembled. In one embodiment, the cable retainer pin 160 is higher than the front sheave pin 115 when the system 100 is assembled and mounted on the weight rack 101.

In one embodiment, the system 100 further includes a plate holder 301. The plate holder 301 is configured to receive weight plates 303 having a center hole 305 therethrough. The plate holder 301 includes a first ring 307 having a diameter less than a hole diameter 305 of the weight plate 303, and a second ring 310 having a diameter greater than the whole diameter 305 of the weight plate 303. A strap 320 connects the first ring 307 to the second ring 310.

In one embodiment, the system 100 further includes a front pad 401 affixed to a rear surface of the front face 132 of the mounting member 107, and a rear pad 403 affixed to a front surface of the rear face 133 of the mounting member 107. The front pad 401 and the rear pad 43 are formed of a polymer material and the pallbearer material is high density polyethylene in one embodiment.

In one embodiment, the system 100 further includes one or more handles 501 configured to attach to a first end of the cable 201 opposite a second end of the cable 2012 which the plate holder 301 is configured to attach.

Figure 6:
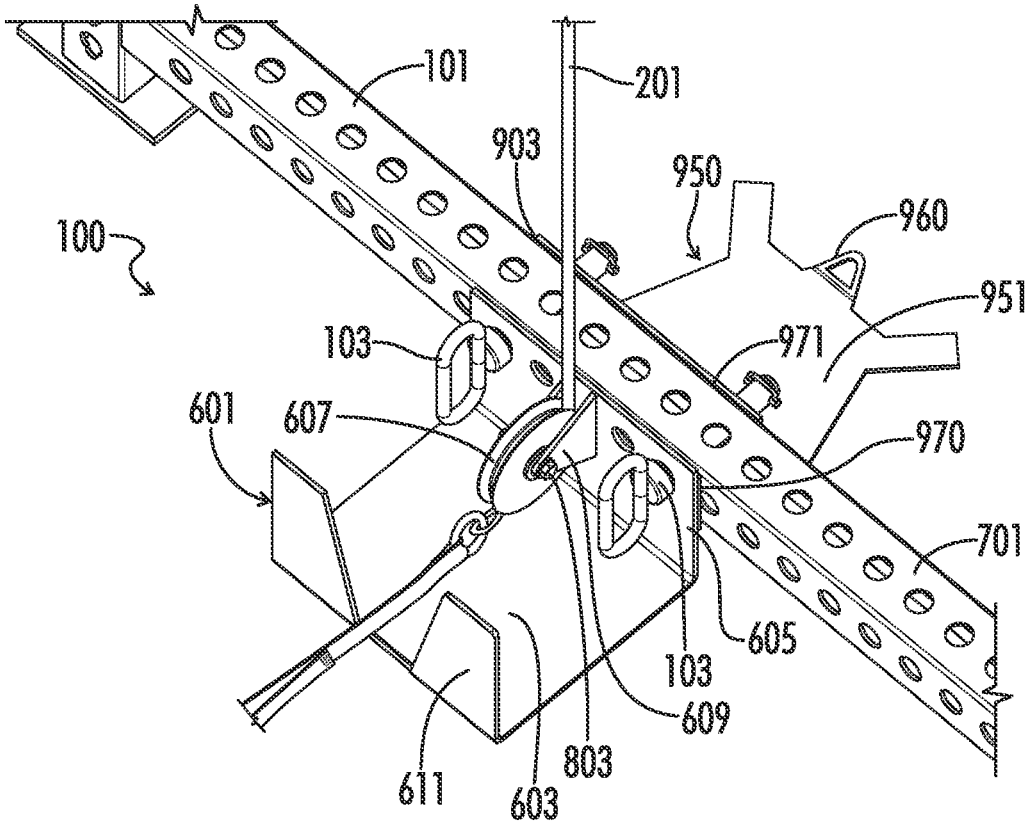
FIG. 6 is an isometric view of a lower front body and lower rear body of the system of FIG. 1.
Figure 7:
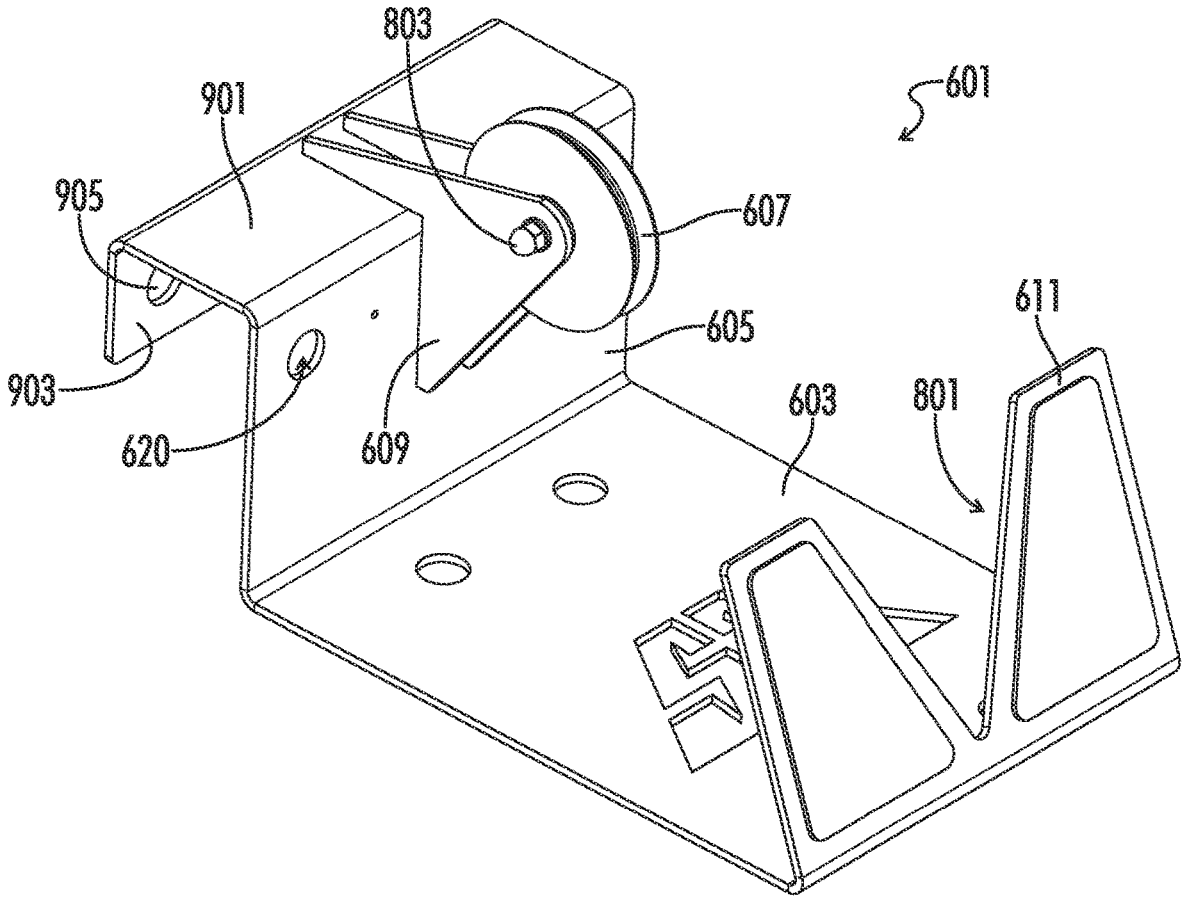
FIG. 7 is an isometric view of another embodiment of the lower front body of FIG. 6.

Referring especially to FIGS. 6 and 7, in one embodiment, the system 100 includes a front lower body 601. The front lower body 601 includes a floorplate 603, a rear face 605, a lower body sheave 607, a sheave support 609, and a front face 611. The floorplate 603 is configured to contact a floor upon which the weight rack 101 is installed in front of the weight rack 101 when the front lower body 601 is installed on the lower crossmember 701 of the weight rack 101 in the upright position.

The rear face 605 extends upwardly from the rear edge of the floorplate 603 when the front lower body 601 is in the upright position. The rear face 605 has at least 2 holes 620 therethrough configured to align with holes in the lower crossmember 701 of the weight rack 101. The holes 620 are configured to receive rack pins 103 therethrough to secure the front lower body 601 to the lower crossmember 701 of the weight rack 101 when the pins 103 are inserted through the at least 2 holes 620 and corresponding holes in the lower crossmember 701.

The lower body sheave is configured to redirect the cable 201 from a vertical to a horizontal direction. The sheave support 609 is configured to support the lower body sheave 607 and stand the lower body sheave 607 off from the rear face 605 of the front lower body 601 when the system 100 is installed on the lower crossmember 701 of the weight rack 101 in the upright position. In one embodiment, the system 100 and the front lower body 601 further include a lower body sheave pin 803 configured to mount the lower body sheave 607 to the sheave support 609. In one embodiment, the lower body sheave pin 803 is positioned directly under the front sheave pin 115 when the system 100 is mounted on the weight rack 101. That is, the first distance 170 is the same as the distance from the lower body sheave pin 803 to the rear face 605 of the front lower body 601.

The front face 611 extends generally upwardly from the front edge of the floorplate 603 when the front lower body is installed on the weight rack 101 in the upright position. The front face 611 has a notch 801 therein extending upward from at least as low as a bottom of a groove in the lower body sheave 607. The front face 611 forms an angle with respect to the floorplate 603 of between approximately 75 and 85°.

In one embodiment, the front lower body 601 further includes a top plate 901 extending rearward from a top of the rear face 605 of the front lower body 601. The top plate 901 is configured to pass over the lower crossmember 701 of the weight rack 101 when the system 100 is installed on the weight rack 101 in the upright position. In one embodiment, the front lower body 601 further includes a rear lower body front face 903. The rear lower body front face 903 has at least 2 holes therethrough configured to line with the at least 2 holes 623 that you rear face 605 of the front lower body 601 and configured to receive the weight rack pins 103 therethrough to secure the front lower body 601 to the lower crossmember 701 of the weight rack 101 when the weight rack pins 103 are inserted through the at least 2 holes 620 in the rear face 605 of the front lower body 601 and the rear lower body front face 903. The rear lower body front face 903 is attached to and extends downward from the front lower body top plate 901 in one embodiment (see e.g., FIG. 7).

In another embodiment, the system 100 further includes a rear lower body 950 including the front face 903 (see e.g., FIG. 6). That is, in one embodiment the front lower body 601 and rear lower body 950 are integral, and in other embodiments, the front lower body 601 and the rear lower body 950 are separate items. In one embodiment, the rear lower body 950 includes a rear floorplate 951 configured to contact the floor upon which the weight rack 101 is installed when the rear lower body 950 is installed on the lower crossmember 701 of the weight rack 101 rearward of the lower crossmember 701. The rear lower body 950 further includes the front face 903 extending upwardly from a front edge of the floorplate 951 when the system 100 is in the upright position. In one embodiment, the rear lower body further includes a rear tab 960 extending upwardly from a rear edge of the floorplate 951. The rear tab 960 has a hole therethrough configured to receive a band or carabiner. The rear tab 960 forms an angle with respect to the floorplate of between approximately 165 and 175°.

In one embodiment, the system 100 further includes a first pad 970 attached to a rear surface of the rear face 605 of the front lower body 601 that is configured to contact the lower crossmember 701 of the weight rack 101 when the system 100 is installed on the lower crossmember 701 of the weight rack 101. The system 100 further includes a second pad 971 attached to the front surface of the front face 903 of the rear lower body 950 that is configured to contact the lower crossmember 701 of the weight rack 101 when the system 100 is installed on the lower crossmember 701 of the weight rack 101.

Referring back the FIGS. 1-7 generally, in one embodiment, a weight rack (e.g., power rack 101) mounted pulley system 100 can be mounted in multiple locations on the same rack 101. Due to the tolerances for crossmember width, the pulley system 100 does not need to be bolted to the weight rack 101. The system 100 is secured by pairs of 1" or ⅝" clevis pins or detent rack pins 103. Prior art rack mounted pulley systems have the pulleys above the weight rack which typically requires over 7" of clearance above the stringers on either side of the weight rack. In one embodiment, the pulley system 100 disclosed herein requires 2.5" or less of clearance over the weight rack 101. In one embodiment, the rearward extension of the overhead pulley (i.e., distance from the rear face of the mounting member to the rear sheave) allows use of full-size Olympic plates 303 or bumpers without hitting the weight rack 101 (i.e., the lower crossmember 701 of the weight rack 101).

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful UNIVERSAL PULLEY SYSTEM FOR POWER RACK it is not intended that such references be construed as limitations upon the scope of this invention except as set forth in the following claims.

What is claimed is:

1. A pulley system for a weight rack, said system comprising:

a main body configured to extend longitudinally, said main body comprising a top, a bottom, a first side, and a second side opposite the first side;

a mounting member configured to extend laterally, wherein the mounting member is at least partially recessed into the bottom of the main body, wherein the mounting member comprises a top, a front face connected to the top, a rear face connected to the top, and an open bottom between the front face and the rear face, wherein:

the mounting member has a first hole through the front face of the mounting member; and the mounting member has a second hole through the rear face of the mounting member, wherein the first and second holes are laterally and vertically aligned such that the first and second holes cooperate to receive a rack pin therethrough when the system is mounted on the weight rack in an upright position to retain the system on the weight rack;

a rear sheave at a rear end of the main body, said rear sheave extending vertically and longitudinally when the system is mounted on the weight rack in the upright position;

a rear sheave pin extending laterally between the first side and the second side of the main body, wherein the rear sheave pin mounts the rear sheave to the main body when the system is assembled;

a front sheave at a front end of the main body, said front sheave extending vertically and longitudinally when the system is mounted on the weight rack in the upright position; and a front sheave pin extending laterally between the first side and the second side of the main body, wherein the front sheave pin mounts the front sheave to the main body when the system is assembled.

2. The system of claim 1, wherein:

the rear sheave pin extends through the rear sheave to mount the rear sheave between the first side and the second side of the main body when the system is assembled and in the upright position; and the front sheave pin extends through the front sheave to mount the front sheave between the first side and the second side of the main body when the system is assembled and in the upright position.

3. The system of claim 1, wherein:

the rear sheave pin extends through the rear sheave to mount the rear sheave between the first side and the second side of the main body when the system is assembled and in the upright position;

the front sheave pin extends through the front sheave to mount the front sheave between the first side and the second side of the main body when the system is assembled and in the upright position;

the system further comprises a first pair of spacers configured to space the rear sheave from the first side of the main body and the second side of the main body;

the first pair of spacers are supported by the rear sheave pin when the system is assembled and in the upright position;

the system further comprises a second pair of spacers configured to space the front sheave from the first side of the main body and the second side of the main body; and the second pair of spacers are supported by the front sheave pin when the system is assembled and in the upright position.

4. The system of claim 1, wherein:

the system further comprises a cable retainer pin extending laterally between the first side and the second side of the main body, wherein the cable retainer pin is forward of the front sheave pin and above the front sheave pin and spaced from the front sheave when the system is assembled.

5. The system of claim 1, wherein:

the front sheave pin is positioned a first distance from the front face of the mounting member when the system is assembled;

the rear sheave pin is positioned a second distance from the rear face of the mounting member when the system is assembled; and the second distance is more than the first distance.

6. The system of claim 1, wherein:

the mounting member has a c-channel cross section across the lateral axis that is open on a bottom of the mounting member when the pulley system is mounted on the weight rack in an upright position.

7. The system of claim 1, wherein:

the first hole through the front face of the mounting member and the second hole through the rear face of the mounting member are ovals which are longer in the lateral direction than the vertical direction when the system is mounted on the weight rack in the upright position.

8. The system of claim 1, wherein:

the front sheave has a groove therein configured to receive a cable;

the rear sheave has a groove therein configured to receive the cable; and the groove in the front sheave and the groove in the rear sheave extend above the top of the main body such that the cable is supported above the top of the main body when the system is installed on the weight rack in the upright position with the cable.

9. The system of claim 1, wherein:

the system further comprises a cable configured to extend between the front sheave and the rear sheave and downward from the front sheave and the rear sheave when the system is installed on the weight rack in the upright position.

10. The system of claim 1, further comprising:

a plate holder configured to attach to a cable of the system, wherein the plate holder is configured receive weight plates having a center hole therethrough, said plate holder comprising a first ring having a diameter less than a hole diameter of a weight plate, a second ring having a diameter greater than the hole diameter of the weight plate, and a strap connecting the first ring to the second ring.

11. The system of claim 1, further comprising:

a front pad affixed to a rear surface of the front face of the mounting member; and a rear pad affixed to a front surface of the rear face of the mounting member, wherein:

the front pad and the rear pad are formed of a polymer material, and said polymer material is high density polyethylene.

12. The system of claim 1, further comprising:

a cable configured to extend between the front sheave and the rear sheave and downward from the front sheave and the rear sheave when the system is installed on the weight rack in the upright position;

a handle configured to attach to a first end of the cable;

a plate holder;

a pair of rack pins, wherein the weight rack pins are one of clevis pins or detent pins;

spacers configured to center the front sheave and the rear sheave laterally within the main body;

a front pad affixed to a rear surface of the front face of the mounting member; and a rear pad affixed to a front surface of the rear face of the mounting member.

13. A pulley system for a weight rack, said system comprising:

a front lower body comprising:

a floor plate configured to contact a floor upon which the weight rack is installed in front of the weight rack when the front lower body is installed on a lower crossmember of the weight rack in an upright position;

a rear face extending upwardly from a rear edge of the floor plate when the front lower body is in the upright position, wherein the rear face has at least two holes therethrough configured to align with holes in the lower crossmember of the weight rack, said holes configured to receive rack pins therethrough to secure the front lower body to the lower crossmember of the weight rack when the pins are inserted through the at least two holes and corresponding holes in the lower crossmember;

a lower body sheave configured to redirect a cable;

a sheave support configured to support the lower body sheave and stand the lower body sheave off from the rear face of the front lower body, said sheave support extending forward from the rear face of the front lower body when the system is installed on the lower crossmember of the weight rack in the upright position; and a front face extending generally upwardly from a front edge of the floor plate when the front lower body is installed on the weight rack in the upright position, wherein the front face has a notch therein extending upward from at least as low as a bottom of a groove in the lower body sheave, wherein the front face forms an angle with respect to the floor plate of between approximately 75 and 85 degrees.

14. The system of claim 13, wherein:

the front lower body further comprises a lower body sheave pin configured to mount the lower body sheave to the sheave support.

15. The system of claim 14, further comprising:

a first pad attached to a rear surface of the rear face of the front lower body, wherein the first pad is configured to contact the lower crossmember of the weight rack when the system is installed on the lower crossmember of the weight rack; and a second pad attached to a front surface of the front face of the rear lower body, wherein the second pad is configured to contact the lower crossmember of the weight rack when the system is installed on the lower crossmember of the weight rack.

16. The system of claim 13, wherein:

the front lower body further comprises a top plate extending rearward from a top of the rear face of the front lower body, said top plate configured to configured to pass over the lower crossmember of the weight rack when the system is installed on the weight rack.

17. The system of claim 13, wherein:

the front lower body further comprises a top plate extending rearward from a top of the rear face of the lower body, said top plate configured to configured to pass over the lower crossmember of the weight rack when the system is installed on the weight rack; and the front lower body further comprises a rear lower body front face, said rear lower body front face having at least two holes therethrough configured to align with the at least two holes through the rear face of the front lower body and configured to receive the weight rack pins therethrough to secure the front lower body to the lower crossmember of the weight rack when the weight rack pins are inserted through the at least two holes in the rear face of the front lower body and the rear lower body front face, wherein the rear lower body front face is attached to and extends downward from the front lower body top plate.

18. The system of claim 13, further comprising:

a rear lower body comprising:

a rear floor plate configured to contact the floor upon which the weight rack is installed when the rear lower body is installed on the lower crossmember of the weight rack rearward of the lower crossmember;

a front face extending upwardly from a front edge of the floor plate when the system is in the upright position, wherein the front face has at least two holes therethrough configured to align with holes in the lower crossmember of the weight rack, said holes configured to receive pins therethrough to secure the rear lower body to the lower crossmember of the weight rack when the weight rack pins are inserted through the at least two holes and the corresponding holes in the lower crossmember;

a rear tab extending upwardly from a rear edge of the floor plate, the rear tab having a hole therethrough configured to receive a band or carabineer, wherein the rear tab forms and wherein the rear tab forms an angle with respect to the floor plate of between approximately 165 and 175 degrees.

19. A pulley system for a weight rack, said system comprising:

a main body configured to extend longitudinally, said main body comprising a top, a bottom, a first side, and a second side opposite the first side;

a mounting member configured to extend laterally, wherein the mounting member is at least partially recessed into the bottom of the main body, wherein the mounting member comprises a top, a front face connected to the top, a rear face connected to the top, and an open bottom between the front face and the rear face, wherein:

the mounting member has a first hole through the front face of the mounting member; and the mounting member has a second hole through the rear face of the mounting member, wherein the first and second holes are laterally and vertically aligned such that the first and second holes cooperate to receive a rack pin therethrough when the system is mounted on the weight rack in an upright position to retain the system on the weight rack;

a rear sheave at a rear end of the main body, said rear sheave extending vertically and longitudinally when the system is mounted on the weight rack in the upright position;

a rear sheave pin extending laterally between the first side and the second side of the main body, wherein the rear sheave pin mounts the rear sheave to the main body when the system is assembled;

a front sheave at a front end of the main body, said front sheave extending vertically and longitudinally when the system is mounted on the weight rack in the upright position;

a front sheave pin extending laterally between the first side and the second side of the main body, wherein the front sheave pin mounts the front sheave to the main body when the system is assembled; and a front lower body comprising:

a floor plate configured to contact a floor upon which the weight rack is installed in front of the weight rack when the front lower body is installed on a lower crossmember of the weight rack in an upright position;

a rear face extending upwardly from a rear edge of the floor plate when the front lower body is in an upright position, wherein the rear face has at least two holes therethrough configured to align with holes in the lower crossmember of the weight rack, said holes configured to receive rack pins therethrough to secure the front lower body to the lower crossmember of the weight rack when the pins are inserted through the at least two holes and corresponding holes in the lower crossmember;

a lower body sheave configured to redirect a cable;

a sheave support configured to support the lower body sheave and stand the lower body sheave off from the rear face of the front lower body, said sheave support extending forward from the rear face of the front lower body when the system is installed on the lower crossmember of the weight rack in the upright position; and a front face extending generally upwardly from a front edge of the floor plate when the front lower body is installed on the weight rack in the upright position, wherein the front face has a notch therein extending upward from at least as low as a bottom of a groove in the lower body sheave, wherein the front face forms an angle with respect to the floor plate of between approximately 75 and 85 degrees.

20. The system of claim 19, wherein:

the lower body sheave is spaced forward from the rear face of the front lower body the same distance as the front sheave is spaced forward from the mounting member.

* * * * *